United States Patent [19]

D'Avanzo

[11] Patent Number: 4,650,034

[45] Date of Patent: Mar. 17, 1987

[54] SAFETY ESCAPE CHUTE

[76] Inventor: Thomas D'Avanzo, 7013 Belroi St., Orlando, Fla. 32818

[21] Appl. No.: 816,412

[22] Filed: Jan. 6, 1986

[51] Int. Cl.[4] ..... A62B 1/20

[52] U.S. Cl. ..... 182/49; 182/51

[58] Field of Search ..... 182/48, 49, 51, 52, 182/127; 272/56.5 R

[56] References Cited

U.S. PATENT DOCUMENTS

| | | | |
|---|---|---|---|
| 139,416 | 5/1873 | O'Brien | 182/48 |
| 268,608 | 12/1882 | Bentley | 182/48 |
| 3,088,542 | 5/1963 | Johnson | 182/48 |
| 3,656,579 | 4/1972 | Fisher | 182/48 |
| 3,921,757 | 11/1975 | Kennedy | 182/48 |
| 4,149,710 | 4/1979 | Rouchard | 272/56.5 |
| 4,339,019 | 7/1982 | Tracy | 182/48 |
| 4,484,739 | 11/1984 | Kreinbihl | 272/56.5 |

FOREIGN PATENT DOCUMENTS

| | | | |
|---|---|---|---|
| 2038257 | 11/1978 | United Kingdom | 182/48 |

*Primary Examiner*—Reinaldo P. Machado
*Attorney, Agent, or Firm*—Macdonald J. Wiggins

[57] ABSTRACT

A safety escape chute for assisting in rescue of persons from burning buildings and the like has a generally U-shaped chute mounted on a vehicle and having a length to reach from the ground to the highest level required. The system includes extensible supports which may be hydraulically operated to extend the upper end of the chute adjacent a window from which persons are to be evacuated. The chute includes a water inlet at the upper end and a drain manifold partway down the chute. Water is pumped out the water inlet so as to form a thin flow of water down the center of the chute which is collected at the drain and returned to the source. This water flow will accelerate persons entering the chute. The vertical side portions of the chute adjacent the water flow are lined with an anti-friction material such that the person may utilize this material to control his rate of descent. Below the drain, the remainder of the chute is covered with anti-friction material to decelerate the person so that he may alight safely on the ground. The system is preferably mounted to a turntable on the vehicle so that it may be rotated to the most advantageous angle for approach to a building.

12 Claims, 8 Drawing Figures

A

SAFETY ESCAPE CHUTE

BACKGROUND OF THE INVENTION

1. Field of the Invention

The present invention relates to portable fire escape systems, and more particularly to a fire escape chute utilizing water flow and means for decelerating the velocity of the escapee.

2. Description of the Prior Art

There is a continuing need for an effective and efficient fire escape device for medium size buildings to safely remove occupants from the windows, especially where other exits may be blocked by fire. The approach of using a chute type device has been tried in the past. In an early patent to Bentley, U.S. Pat. No. 268,608, a slideway mounted on a truck is raised to a point at which a person who may be disabled is lowered through the slideway by means of a chain arrangement. The device can only handle one person at a time and would be required to be operated rather slowly. A safety chute is disclosed by Tracy in U.S. Pat. No. 4,339,019 in which a platform is raised on a vertical boom to a window and a cable suspending a fabric chute is anchored to the ground from the platform. A person to be rescued slides down the chute and deceleration restrictions are included in the lower portion of the chute to slow the person to a safe speed. Johnson et al in U.S. Pat. No. 3,088,542 teach a plurality of cylinders formed from metal or composition. These must be assemblied at the site and raised to a window. No means of deceleration is provided. A foam pad or the like is placed at the bottom of the chute to catch the person descending therethrough. Miller in U.S. Pat. No. 3,033,308 discloses a semi-circular segmented chute mounted on a truck or the like which can be folded for transport and extended for use. A net supported by legs is provided to catch the person coming down the chute.

In U.S. Pat. No. 3,921,757 to Kennedy, a concave safety net attached between two horizontal cross arms that spread the net laterally is disposed by telescoping booms attached to the bed of a truck. The upper cross arm is raised toward windows from which persons are attempting to evacuate a building. The person is expected to jump a necessary distance to the net and to slide the remaining distance to the ground along the surface of the net. The upper cross arm includes nozzles which can wet the net for both protection from fire and to reduce friction. At the base of the net, openings are provided which guide the person through a chute-like device onto a landing net or pad. Although the concavity of the net would tend to slow persons down at the lower end, this will depend upon the height from which the person has jumped. Thus, there is an element of danger is present in this type of rescue device.

Thus, there is a need for a simple rescue chute which can be quickly raised to the window openings in a burning building or the like, and in which persons will exit one at a time and can be quickly accelerated and decelerated as required to permit them to land on the ground without injury.

SUMMARY OF THE INVENTION

My invention utilizes a flat bed truck or trailer having mounted thereon a rotatable turntable supporting a pair of telescoping masts or braces. At the outer ends of the telescoping braces, a chute is disposed. The chute may be any desired length and the length of the braces will be selected to raise an upper end of the chute to the desired height. It is believed that the apparatus will find its most useful applications for four to five story buildings.

When the chute is raised, the lower end will be adjacent the ground while the upper end will be adjacent a window or other building opening through which rescue is to be effected. The slide may be formed from sheet metal or suitable plastic material having sufficient strength for the application. I prefer a generally U-shaped cross section having a width of about 3 feet and a depth of about 18 inches, thus forming a channel down which a person may slide.

As will be understood, it is desirable that a person to be rescued be able to easily slide down the chute but that their velocity be reduced prior to reaching the lower end of the chute. To ensure that a person, regardless of the amount of clothing that he may be wearing, be able to quickly accelerate when he enters the chute, I provide a flow of water from the top end of the chute downward. This will permit a person entering the chute to very quickly clear the upper end to permit the next person to leave the building and enter the upper end of the chute. To assist the person sliding down the chute in controlling his descent, I provide a coating of friction-type material along the inner surfaces of the upright sidewalls of the chute. The person may use his arms or legs against this material to control the speed of descent while water is flowing down the central portion of the chute. Foam rubber pads or the like are suitable for friction material in accordance with my invention.

About mid-way down the chute, I provide a manifold disposed below the chute and attached thereto with a multiplicity of holes through the bottom area of the chute. This manifold will collect the water flowing down the chute and will return it through a suitable hose to a reservoir. The water injected at the upper end of the chute is drawn by a pump from the reservoir thereby continually circulating the same water. The portion of the chute below the manifold is completing lined with friction material such as foam rubber. Thus, this material acts to decelerate the person on the final stage of his movement down the chute. An air bag or other suitable cushioning device may be placed on the ground adjacent the end of the chute to absorb any remaining velocity that the person's body may have.

The truck body also mounts an engine and power source, preferably driving a hydraulic pump system, to power the extensible telescoping braces and the turntable upon which the braces are mounted. In some instances, the truck may be placed at right angles to the building wall and the safety chute of my invention extended upward to the desired point. However, in other instances, it may be desirable to approach a building from a narrow alleyway or there may be obstacles which may prevent the ideal placement of the truck. In such instances, the turntable may be rotated to approach the building.

In many instances, it may not be possible to get the upper end of the chute in contact with the window or other opening area. To cope with this situation, I provide a short ladder and extension device to bridge a space between the window and the top end of the chute, which permits a person to access the chute.

It is therefore a principal object of my invention to provide a vehicle mounted chute at which an upper end thereof can be raised to a building to provide a means of escape from the building in cases of fire and the like.

It is another object of my invention to provide an escape chute for a building in which a flow of water is provided down an upper part of the chute to quickly accelerate a person entering the chute and deceleration means is provided in the lower end of the chute to reduce the velocity of the person as he nears the ground.

These and other objects and advantages of the invention will become apparent from the following detailed description when read in conjunction with the drawings.

DETAILED DESCRIPTION OF THE PREFERRED EMBODIMENT

Figures 1, 2, 3, 4, 4A:
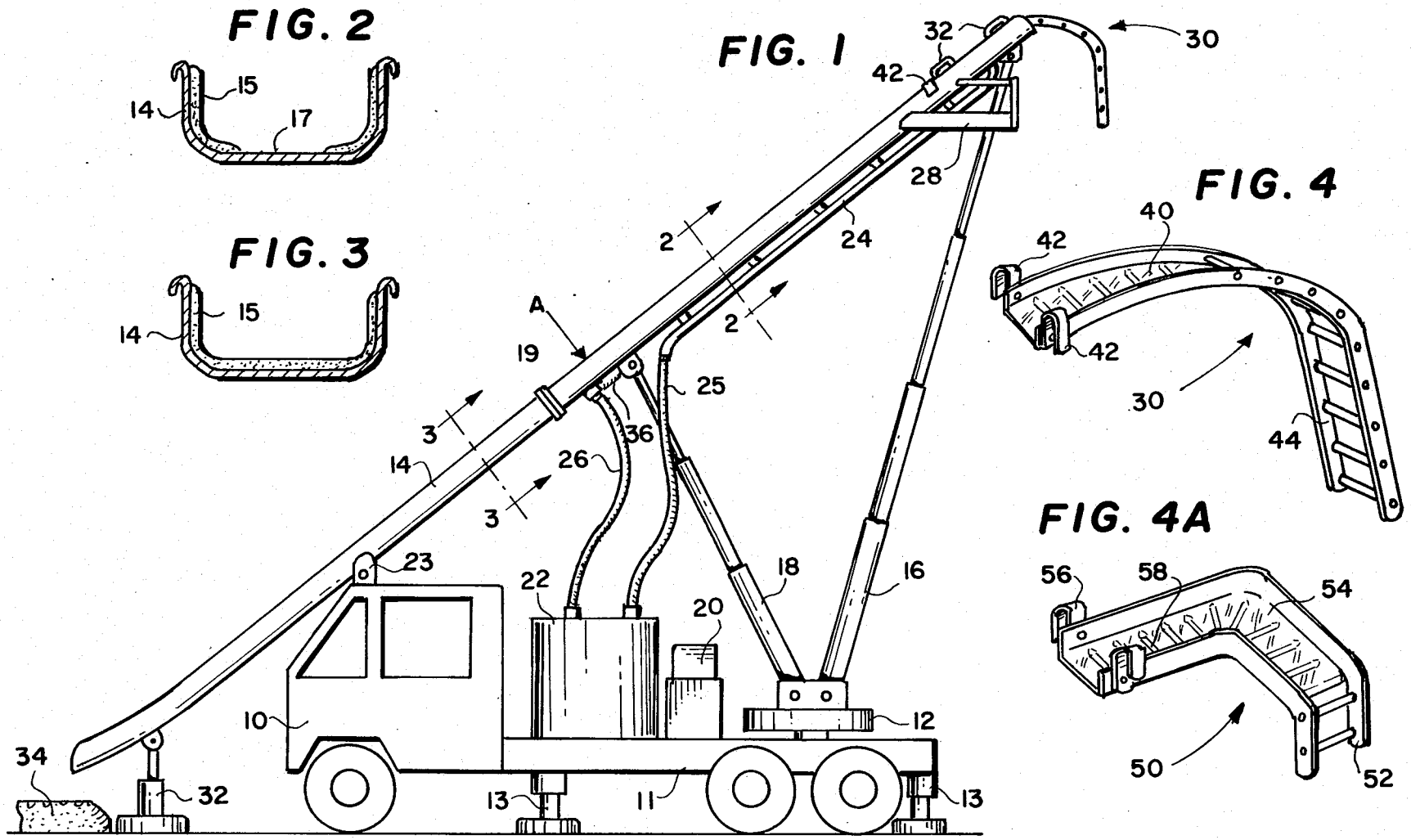
FIG. 1 is a side view of a truck with the escape chute of the invention mounted thereon.
FIG. 2 is a cross-sectional view through the chute of FIG. 1 in plane 2—2.
FIG. 3 is a cross-sectional view of the chute of FIG. 1 through the plane 3—3.
FIG. 4 is a perspective view of a ladder and extension unit used at the top end of the chute of FIG. 1.
FIG. 4A is a perspective view of a right angle extension unit used at the top of the chute of FIG. 1.

Referring first to FIG. 1, a side view of my fire escape chute is shown mounted on a truck 10. Truck 10 includes a chassis 11 having a turntable 12 mounted thereon. Turntable 12 may be controlled from the cab of the vehicle 10 and preferably utilizes hydraulic motors operated from hydraulic pump system 20 mounted on chassis 11.

Turntable 12 includes a pair of telescoping extensible supports or braces 16 and 18. The length of braces 16 and 18 may be selected depending upon the desired height to which the chute of my invention will be extended. Generally, a height of 35 to 45 feet is practical. Braces 16 and 18 support chute 14. The supports 16 and 18 may be fully retracted permitting chute 14 to assume an essentially horizontal position for transport. Where the length of chute 14 would make transport difficult, chute 14 can be formed from two or more sections. In FIG. 1, two sections are shown joined by a suitable coupling 19. Coupling 19 may include a hinge assembly 21 to permit the lower section to fold over the upper section. Alternatively, coupling 19 may be separable and chute 14 removed from supports 16 and 18 for transport.

In FIG. 1, turntable 12 is oriented such that chute 14 is essentially parallel with truckbed 11 and is supported on the cab 10 by roller 13. Although not shown, means may be provided for locking chute 14 to the roller 13 for transport if a single section chute is used.

When the apparatus is deployed at a site, it is preferably utilized in the position shown in FIG. 1 with the upper end of chute 14 adjacent a window or other opening in the building involved. Jackpads 13 attached to chassis 11 are provided and may be hydraulically operated to anchor the truck 10 securely during rescue operations. Similarly, a manually operated jackpad 32 is attached at the lower end of chute 14 to provide support at that point.

Chute 14 is preferably U-shaped as best seen in the cross-sectional view of FIG. 2 and FIG. 3. FIG. 2 is a cross-sectional view of chute 14 through plane 2—2 of FIG. 1 and is representative of the chute from the top end downward to point A indicated by the arrow. The chute 14 may be formed from sheet metal or a suitable plastic material. The inner vertical walls of the upper section are coated with an anti-friction material which may be thin sheets of foam rubber or other similar material. An open area 17 remains down the centerline of chute 14 to permit rapid acceleration of a person using the invention. From point A of FIG. 1 to the lower end of chute 14, the entire inner surface of the chute is covered with the anti-friction material 15 as shown in FIG. 3. As will be recognized, this material will serve to decelerate the velocity of a person using the chute.

At the upper end of chute 14 of FIG. 1, handle grips 42 may be attached to the edges of the chute to assist a user to enter the chute. A platform 28 may be attached to the upper end of the chute with provisions for a fireman or rescue worker to occupy the platform during placement of the chute and to assist persons to enter the chute. As will be shown in more detail hereinafter, a flow of water is directed into the area 17 of FIG. 2 which will flow downward and will be collected at point A in FIG. 1. As will be recognized, the water will assist in accelerating persons entering the chute 14, especially where the person may be wearing clothing having considerable friction with the chute otherwise. Although the water may be obtained from any convenient source, I prefer to provide a tank 22 with suitable pumping apparatus included in power source 20. Water is pumped up through hose 25 to input line 24 to the top of the chute 14 and is collected in a manifold 36 at point A and returned to tank 22. Thus, no water is diverted from fire fighting use.

A bridging device 30 may be used to assist persons to enter chute 14. Details of bridging device 30 are shown in FIG. 4. When the apparatus of FIG. 1 is to be used, chute 14 is disposed with its upper end as close as possible to a window sill, with ladder 44 of bridging device 30 hooked over the window sill to the floor of the adjacent room. This permits easy access to chute 14 by persons within the room. In instances where the upper end of chute 14 cannot be moved directly to an open window, the bridging device 30 may be utilized as a bridge in which hooks 42 are hooked over the lateral edges of chute 14 and bridge portion 40 is extended over to the window. The surface of bridge 40 may be corrugated or covered with an anti-slip material to provide maximum safety to a person using the bridge. For use when the building must be approached parallel to a wall, the bridging device 50 shown in FIG. 4A may be used. A right angle bridge is attached to the top end of chute 14 by hooks 56 and a ladder portion 52 is hooked over the window sill. Surface 54 of bridging device 50 may be corrugated as shown at 58 or covered with anti-slip material.

Having described the structure of my invention, the operation thereof will now be described. When a multistory building is involved with fire, the truck 10 is driven to the site and is backed up to a wall having windows from which persons may attempt to escape. The supports 16 and 18 are raised to place the upper end of chute 14 at the desired window. A rescue worker may ride the chute upward in platform 28 and assist in opening windows, breaking out windows and orienting the chute and bridge assembly 30. When the assembly 30 is in place, the jack pads 13 and 32 are operated to secure the vehicle 10. An air bag or other type of soft pad 34 may be disposed on the ground at the lower end of chute 14 to receive the persons escaping.

The operator energizes the pump of power unit 20 to introduce water at the upper end of the chute 14 which is adjusted to give a smooth laminar flow of water down the central area of chute 14 to be collected to point A by manifold 36. The rescue worker may then assist persons from the window onto the upper end of the chute and permit them to slide downward and to be accelerated by the effect of the water flowing down the chute. The person may control his rate of descent somewhat by contacting the anti-friction material 15 as his slide progresses. When the person reaches point A, the remainder of the distance will be down the portion of chute 14 lined with the anti-friction material 15. This increased friction will slow the velocity of descent sufficiently so that the person may be deposited on pad 34 with minimum risk of injury.

When it is not possible due to structures and the like to approach the desired windows, truck 10 may be parked at an angle with respect to the building or even parallel with the building. In such cases, the operator energizes the turntable 12 and rotates the chute 14 to place it as near as possible to a right angle with the building wall. However, it will also be recognized that the chute 14 may be placed at almost any angle with respect to the building and auxiliary short ladders or the like may also be utilized to permit occupants to climb out to the upper end of the chute 14. Such use will be obvious to skilled firefighters.

Figure 5:
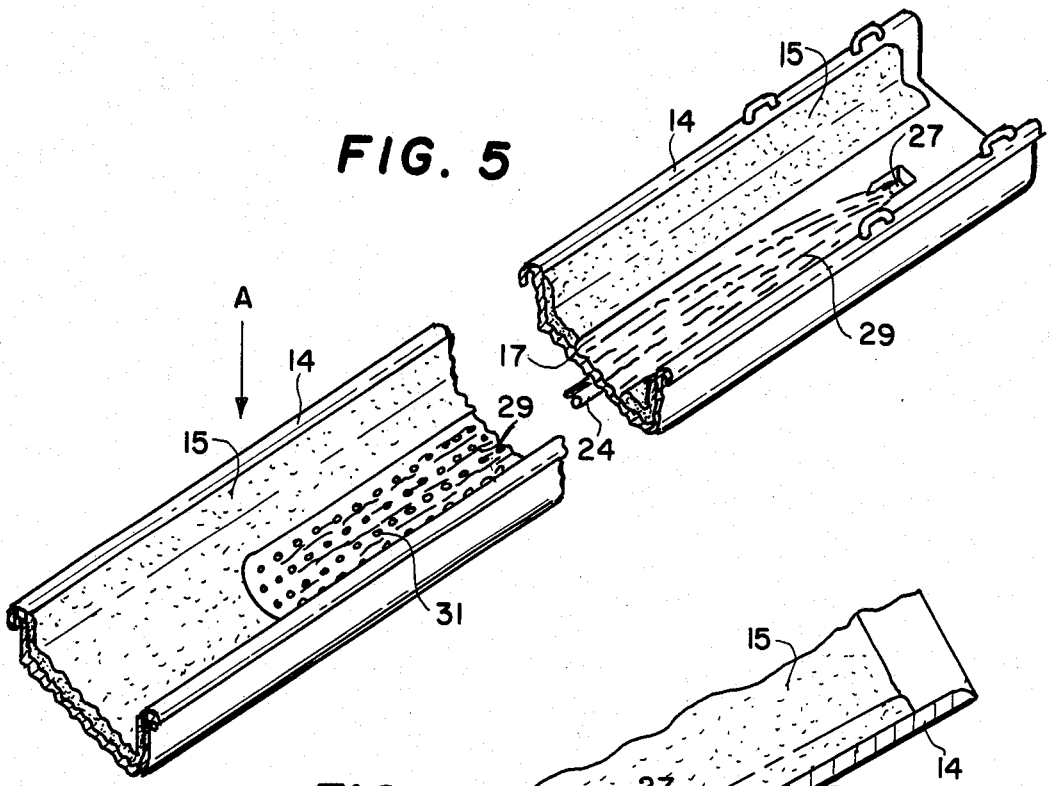
FIG. 5 is a fragmented view of the chute of FIG. 1 showing the water flow area and the deceleration area of the chute.
Figure 6:
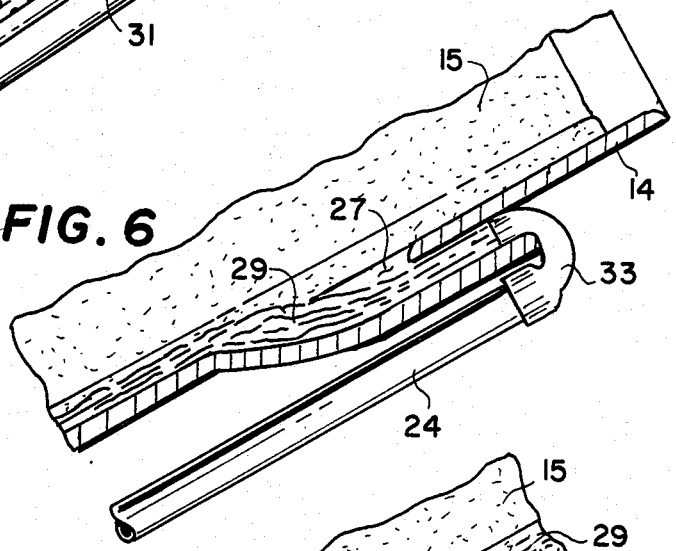
FIG. 6 is a cross-sectional view of the water inlet portion of the chute.
Figure 7:
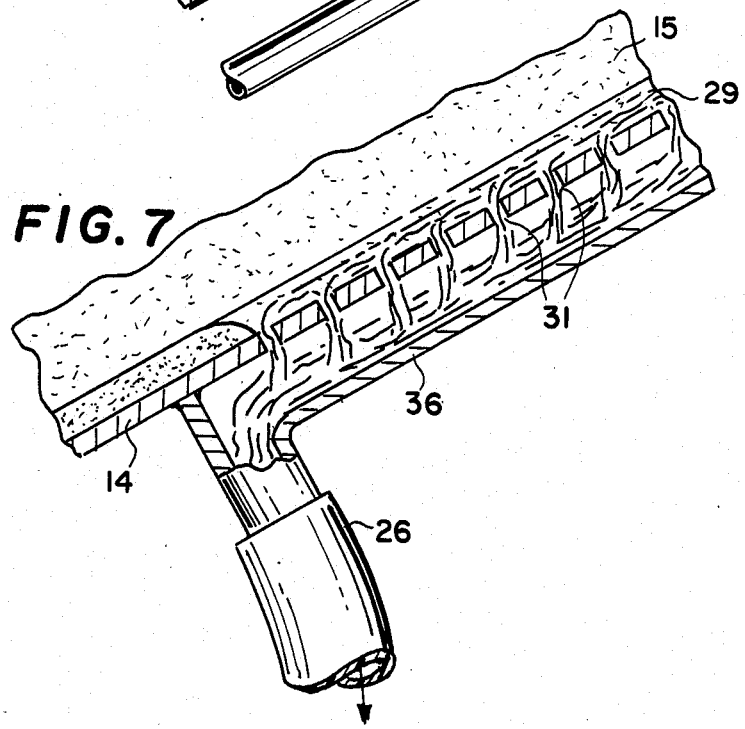
FIG. 7 is a cross-sectional view of the water collection and drain section of the chute.

Turning now to FIGS. 5, 6, and 7, additional details of the novel water acceleration system of my invention will be described. In FIG. 5, a fragmentary view of chute 14 is shown. A recessed inlet 27 for water is provided near the upper end of chute 14. Water 29 from inlet 27 flows down the uncovered portion 17 of chute 14 and exits through a multiplicity of openings 31 at point A of chute 14. As previously mentioned, the flow of water is adjusted to produce a thin film of water 29 such that the majority of the water is collected through openings 31 for return to the tank 22.

Details of the inlet 27 are shown in the cross-sectional view of FIG. 6. Inlet 27 is formed by a curved downwardly extending portion of the bottom surface of chute 14 with the open edges rounded to prevent the inlet 27 from interfering with a person entering the chute. In many instances, the opening will be covered by the bridge element 40. Water supply line 24 is connected to the inlet 27 by a fitting 33 preferably formed from polyvinylchloride or similar material.

FIG. 7 shows a cross-sectional view of manifold 36. Manifold 36 encompasses the plurality of openings 31 in chute 14 and includes an outlet connected to drain hose 26 back to tank 22. This construction permits a person to slide over the manifold area without encountering large openings or other obstructions which could cause injury.

Although I have illustrated a preferred embodiment of my invention in the above-description, I do not intend to be restricted to this specific structure. As will be obvious to those of skill in the art, the invention may be implemented in other ways. For example, the system may be mounted on a trailer to be pulled in back of a fire engine or other tractor unit. The water used may be supplied from already available pumping systems on fire equipment or from fire hydrants. Although I have indicated that I prefer a hydraulic system for operation of the elevating units, other means such as drives from an engine power takeoff or the like, or electric drive units are also suitable. Therefore, such modifications are considered to fall within the spirit and scope of my invention.

I claim:

1. A safety escape chute for permitting persons to escape from burning buildings and the like comprising:

a chute having a generally U-shaped lateral cross section;

extensible support means for raising a first end of said chute to a desired height adjacent a building and for maintaining a second end adjacent the ground;

a water inlet at said first end of said chute, said water inlet connected to a source of water for producing a flow of water down said chute to accelerate a person entering said chute;

a water outlet disposed at an intermediate point along said chute for collecting said flow of water; and anti-friction material disposed along said chute from said intermediate point to said second end for decelerating a person prior to alighting on the ground.

2. The chute as recited in claim 1 in which said support means and said chute are mounted on a vehicle.

3. The chute as recited in claim 2 which further comprises a turntable attached to said vehicle for mounting of said support means for permitting said chute to be rotated with respect to said vehicle.

4. The chute as recited in claim 3 in which said vehicle includes a water reservoir and pumping means connected to said water inlet and outlet for circulating water to said slide.

5. The chute as recited in claim 4 in which said vehicle includes a power source for extending and retracting said support means, and for rotating said turntable.

6. The chute as recited in claim 5 in which said support means includes:

a first telescoping support arm mounted on said vehicle and attached adjacent said first end of said chute;

a second telescoping support arm mounted on said vehicle and attached to said chute at an intermediate point; and hydraulic cylinders disposed in said first and second support arms for extending and retracting the same.

7. The chute as recited in claim 1 which further comprises a bridging device for connecting to said first end of said chute and insertion through an opening in a building to permit entry of persons to said chute.

8. The chute as recited in claim 1 which further comprises a cushioned pad disposed on the ground adjacent said second end of said chute.

9. The chute as recited in claim 1 in which said chute is formed from interconnecting sections.

10. The chute as recited in claim 1 in which said chute is formed from two sections hingedly attached to each other.

11. The chute as recited in claim 1 in which a platform is disposed adjacent said first end of said chute for a rescue worker.

12. An apparatus for permitting a person to escape from a tall structure comprising:

a vehicle;

an elongated open chute having a generally U-shaped cross section disposed on said vehicle and having an upper end for positioning adjacent the tall structure and a lower end for positioning near the ground, said chute thereby forming an acute angle with the ground;

a pair of telescoping adjustable support arms mounted on said vehicle, one of said arms attached to said upper end of said chute and the other of said arms attached to an intermediate point along said chute;

power means connected to said support arms for moving said chute from an essentially horizontal position to a position placing said upper end at a desired height and said lower end adjacent the ground;

a water supply reservoir mounted on said vehicle;

pumping means connected to said reservoir;

a water inlet disposed at said upper end of said chute and connected to said pumping means for providing a flow of water down said chute;

a water drain disposed at an intermediate point along said chute and connected to said reservoir for collecting said water flow and returning said water to said reservoir;

anti-friction material disposed along the vertical interior surfaces of said U-shaped chute from said upper end to said intermediate point for permitting a person in said chute to control his rate of descent; and anti-friction material disposed along the vertical and horizontal interior surfaces of said chute from said intermediate point to said lower end to decelerate a person prior to his alighting on the ground.

* * * * *